US012121163B2

(12) United States Patent
Pfeifer

(10) Patent No.: US 12,121,163 B2
(45) Date of Patent: Oct. 22, 2024

(54) CORRUGATED SHELVING DISPLAY WITH TWO-PIECE SHELVES

(71) Applicant: Menasha Corporation, Neenah, WI (US)

(72) Inventor: Mike Pfeifer, Hartford, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 18/473,684

(22) Filed: Sep. 25, 2023

(65) Prior Publication Data

US 2024/0032710 A1 Feb. 1, 2024

Related U.S. Application Data

(63) Continuation of application No. 18/047,857, filed on Oct. 19, 2022, now Pat. No. 11,805,926, which is a continuation of application No. 17/386,037, filed on Jul. 27, 2021, now Pat. No. 11,517,129, which is a continuation of application No. 16/942,315, filed on Jul. 29, 2020, now Pat. No. 11,154,145.

(51) Int. Cl.
*A47F 5/11* (2006.01)
*A47B 43/02* (2006.01)

(52) U.S. Cl.
CPC ..... *A47F 5/116* (2013.01); *A47B 43/02* (2013.01)

(58) Field of Classification Search
CPC ..... A47F 5/116; A47F 5/114; A47F 5/112; A47B 43/02; A47B 55/06; A47B 47/06
USPC ..... 211/135, 72, 126.16; 229/123.2, 201, 229/202, 207, 237, 240, 244
See application file for complete search history.

(56) References Cited

U.S. PATENT DOCUMENTS 1,964,880 A * 7/1934 Katz ..... A47F 5/116 211/72
2,150,743 A * 3/1939 Mancuso ..... G09F 5/00 229/108.1
2,307,992 A * 1/1943 Calhoun ..... A47F 5/112 211/195
2,666,531 A * 1/1954 Anderson, Jr. ..... A47F 5/112 108/99
2,743,021 A * 4/1956 Glenn ..... A47F 5/112 211/49.1
2,918,178 A * 12/1959 Leone ..... A47F 5/116 211/195
4,311,100 A * 1/1982 Gardner ..... A47F 5/116 108/165
4,618,115 A * 10/1986 Belokin, Jr. ..... A47F 5/116 248/174
4,809,847 A * 3/1989 Schneider ..... B65D 77/042 312/117
5,190,211 A * 3/1993 Stoddard ..... A47F 5/116 229/120.21
5,213,220 A * 5/1993 McBride ..... A47B 55/06 211/132.1
5,315,936 A * 5/1994 Smith ..... A47F 5/116 108/165
5,443,168 A * 8/1995 Dyment ..... A47F 5/116 211/186

(Continued)

*Primary Examiner* — Jennifer E. Novosad
(74) *Attorney, Agent, or Firm* — Richard C. Himelhoch; UB Greensfelder LLP

(57) ABSTRACT

A shelving display formed from a blank of material including a plurality of shelves formed from a first shelf component and a second shelf component.

20 Claims, 9 Drawing Sheets

(56) References Cited

U.S. PATENT DOCUMENTS 5,465,851 A * 11/1995 Smith ..... A47F 5/11 108/162
5,669,683 A * 9/1997 Moss ..... A47B 47/06 312/259
5,678,492 A * 10/1997 Pinkstone ..... A47B 43/02 108/165
5,826,732 A * 10/1998 Ragsdale ..... A47F 5/116 108/165
7,007,615 B2 * 3/2006 Grueneberg ..... A47F 5/116 108/165
7,571,820 B2 * 8/2009 Alexander ..... A47F 5/10 211/73
7,677,433 B2 * 3/2010 Little ..... B65D 5/526 229/120.31
7,703,864 B2 * 4/2010 Moser ..... B65D 5/5213 312/261
7,905,365 B2 * 3/2011 Virvo ..... A47F 5/116 211/73
8,485,370 B2 * 7/2013 Dewhurst ..... A47F 5/0018 211/149
9,211,021 B2 * 12/2015 Smith ..... A47F 5/116
9,844,282 B2 * 12/2017 Smith ..... A47B 43/02
9,907,414 B2 * 3/2018 Heuer ..... A47B 96/021
9,918,569 B1 * 3/2018 Abel ..... B65D 5/5213
10,117,529 B2 * 11/2018 Abel ..... A47F 5/116
10,123,635 B2 * 11/2018 Lilja ..... A47B 43/02
10,448,758 B1 * 10/2019 Abel ..... A47B 43/02
10,470,591 B1 * 11/2019 Heiden ..... A47F 5/116
10,524,588 B2 * 1/2020 Pratsch ..... A47B 43/02
10,531,750 B1 * 1/2020 Heiden ..... A47F 5/0018
10,568,422 B2 * 2/2020 Gibbons, Jr. ..... A47B 43/02
10,568,439 B2 * 2/2020 Bersamin ..... A47F 5/116
10,888,180 B2 * 1/2021 Robinson ..... A47F 5/16
11,019,943 B2 * 6/2021 Burgert ..... A47F 5/116
11,154,145 B1 * 10/2021 Pfeifer ..... A47B 43/02
11,517,129 B2 * 12/2022 Pfeifer ..... A47F 5/116
11,805,926 B2 * 11/2023 Pfeifer ..... A47F 5/116
2008/0173602 A1 * 7/2008 Field ..... A47F 5/116 211/149
2010/0006529 A1 * 1/2010 Groff ..... A47F 5/116 211/186
2010/0025344 A1 * 2/2010 Virvo ..... A47F 5/116 211/59.2
2013/0264923 A1 * 10/2013 Brady ..... A47B 43/02 312/258
2013/0277324 A1 * 10/2013 Dewhurst ..... A47F 5/0018 211/153
2016/0066711 A1 * 3/2016 Mestres Armengol ..... A47F 5/112 211/195
2018/0289178 A1 * 10/2018 McMillan-Sweat .... A47F 5/116
2019/0008290 A1 * 1/2019 Ertl ..... B65D 21/086
2019/0014927 A1 * 1/2019 Nixon ..... A47B 55/06
2019/0380513 A1 * 12/2019 Frost ..... A47F 5/112
2020/0077816 A1 * 3/2020 Doane ..... A47B 43/02
2020/0221866 A1 * 7/2020 Dell ..... A47F 7/145
2020/0288881 A1 * 9/2020 Burgert ..... A47F 5/116
2020/0297132 A1 * 9/2020 Nguyen ..... A47F 5/116
2020/0375375 A1 * 12/2020 Robinson ..... A47B 55/06
2021/0015273 A1 * 1/2021 Nelson ..... A47F 5/116
2021/0298493 A1 * 9/2021 Rose ..... B65D 5/526
2024/0032710 A1 * 2/2024 Pfeifer ..... A47B 43/02

* cited by examiner

CORRUGATED SHELVING DISPLAY WITH TWO-PIECE SHELVES

CROSS-REFERENCE TO RELATED APPLICATIONS

The present application is a continuation of U.S. patent application Ser. No. 18/047,857, filed Oct. 19, 2022, which is a continuation of U.S. patent application Ser. No. 17/386,037, filed Jul. 27, 2021, now U.S. Pat. No. 11,517,129, which is a continuation of U.S. patent application Ser. No. 16/942,315, filed Jul. 29, 2020, now U.S. Pat. No. 11,154,145, the contents of which are incorporated herein by reference and made a part hereof.

FEDERALLY SPONSORED RESEARCH OR DEVELOPMENT

N/A

FIELD OF THE INVENTION

The present invention generally relates to a shelving display formed from a blank of material having a plurality of shelves each cooperatively formed by a first panel and a second panel.

BACKGROUND OF THE INVENTION

A variety of systems are used to display merchandise. Some of these systems can be costly and difficult to manufacture, as well as ship or set up on site.

The present invention provides an embodiment of a shelving display that overcomes the problems of prior displays.

SUMMARY OF THE INVENTION

A shelving display is disclosed having a back wall having a generally U-shaped portion removed defining two spaced-apart, deflectable tabs, a stop panel therebetween, and a pair of slots. One of each slot is associated respectively with one of each of the two deflectable tabs and extends through the back wall. A first side wall extends from a first side of the back wall toward a front portion of the display. A second side wall extends from a second side of the back wall toward a front portion of the display. A first shelf formed from a first shelf component and a second shelf component extends between the first side wall and the second side wall. The first shelf component has a first shelf panel extending between the first side wall and the second side wall approximately midway from the back wall to the front portion of the display. The first shelf panel is integrally connected to a strip of material glued to an interior surface of one of the first and second side walls. A leading edge of the first shelf panel has a pair of spaced-apart flanges, one of each of the flanges being positioned respectively in one of each of the pair of slots. A portion of each of the pair of flanges extends outward of the back wall. The second shelf component has a second shelf panel extending between the first side wall and the second side wall proximate the front portion of the display.

Also disclosed is a multiple shelve shelving display having a back wall having a generally U-shaped portion removed defining two spaced-apart, deflectable tabs, a stop panel therebetween, and a pair of slots. One of each slot is associated with one of each of the two deflectable tabs and extends through the back wall. A first side wall extends from a first side of the back wall toward a front portion of the display. A second side wall extends from a second side of the back wall toward a front portion of the display. A plurality of shelves extend between the first side wall and the second side wall and are vertically spaced from one another. Each shelf of the plurality of shelves includes a first shelf component and a second shelf component extending between the first side wall and the second side wall. The first shelf component has a first shelf panel extending between the first side wall and the second side wall approximately midway from the back wall to the front portion of the display. The first shelf panel is integrally connected to a strip of material glued to an interior surface of one of the first and second side walls. A leading edge of the first shelf panel has a pair of spaced-apart flanges, one of each of the flanges being positioned respectively in one of each of the pair of slots. A portion of each of the pair of flanges extends outward of the back wall. The second shelf component has a second shelf panel extending between the first side wall and the second side wall proximate the front portion of the display.

Also disclosed is a blank of corrugated material for creating a shelving display having two-part shelves. The blank has a back wall panel having a plurality of U-shaped cutouts spaced from one another and each of the plurality of U-shaped cutouts define two spaced-apart, deflectable tabs, a stop panel therebetween, and a pair of slots. One of each slot is associated with one of each of the two deflectable tabs and extends through the back wall panel. The back wall panel is integrally connected on a first side to a first side of a positioning panel. The positioning panel is integrally connected on a second side to a first side of a first shelf panel. The back wall panel is integrally connected on a second side to a first side of a first side wall panel, the first side wall panel integrally connected on a second side to a first side of a second shelf panel. The second shelf panel is integrally connected on a second side to a first side of a second side wall panel. The first shelf panel includes a plurality of first shelf components and the second shelf panel includes a plurality of second shelf components. Each of the plurality of second shelf components of the second shelf panel cooperate with a corresponding one of the plurality of first shelf components of the first shelf panel to form a plurality of shelves for the display.

Other features and advantages of the invention will be apparent from the following specification taken in conjunction with the following figures.

BRIEF DESCRIPTION OF THE FIGURES

To understand the present invention, it will now be described by way of example, with reference to the accompanying figures in which.

DETAILED DESCRIPTION OF THE INVENTION

While this invention is susceptible of embodiments in many different forms, there is shown in the figures and will herein be described in detail preferred embodiments of the invention with the understanding that the present disclosure is to be considered as an exemplification of the principles of the invention and is not intended to limit the broad aspect of the invention to the embodiments illustrated.

Figure 6:
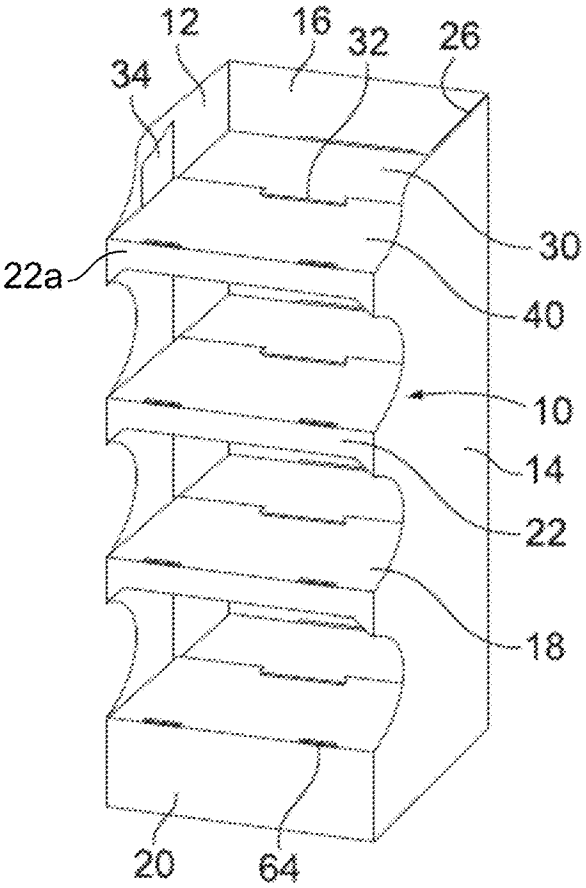
FIG. 6 PRIOR ART
FIG. 6 is a front perspective view of a prior art shelving display having two-part shelves.
Figure 5:
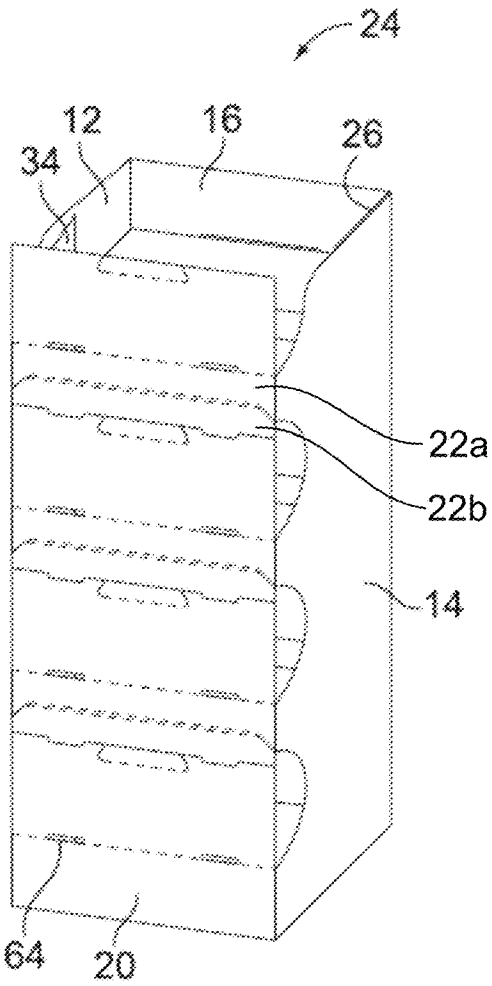
FIG. 5 PRIOR ART
FIG. 5 is a perspective view of the prior art blank of FIG. 1 further folded from the position in FIG. 4.
Figure 4:
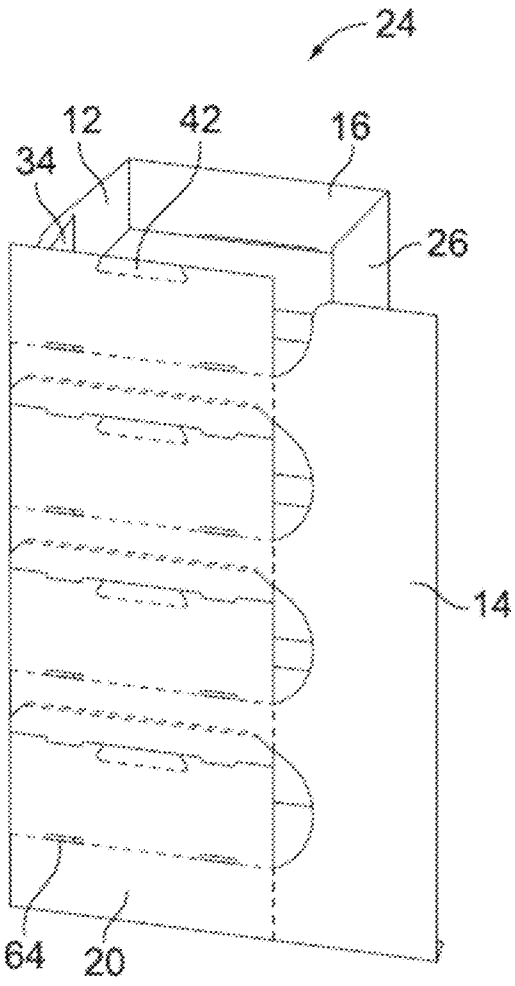
FIG. 4 PRIOR ART
FIG. 4 is a perspective view of the prior art blank of FIG. 1 further folded from the position in FIG. 3.

A shelving display 10 is shown set-up in FIG. 6. The shelving display 10 includes a first side wall 12 and a second side wall 14. The first and second side walls 12, 14 extend from a back wall 16.

A plurality of shelves 18 are supported between the first side wall 12 and the second side wall 14. The bottom shelf of the plurality of shelves 18 includes a front panel 20 that extends downward to the floor to form a base of the shelving display 10 along with lower portions of the first side wall 12, the second side wall 14, and the back wall 16. The embodiment shown in FIG. 6 includes four shelves 18. However, a shelving display made in accordance with the inventions of the present application can include more or fewer shelves. As discussed below, each of the plurality of shelves 18 is formed from two parts—a first shelf component is provided from a first shelf panel 28, and a second shelf component is provided from a second shelf panel 38.

Figure 1:
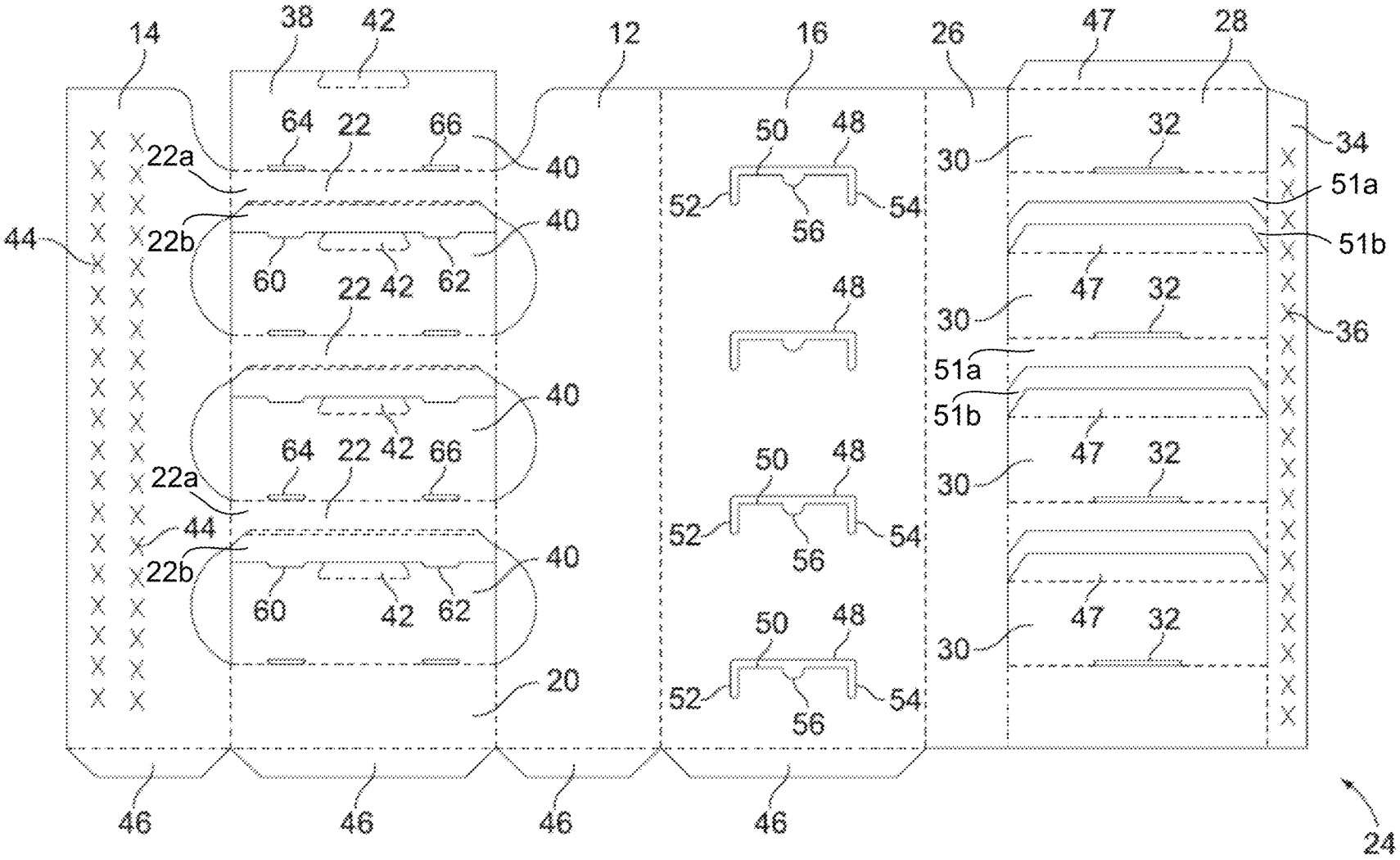
FIG. 1 PRIOR ART
FIG. 1 is a plan view of a prior art blank of corrugated material for constructing a shelving display.
Figure 3:
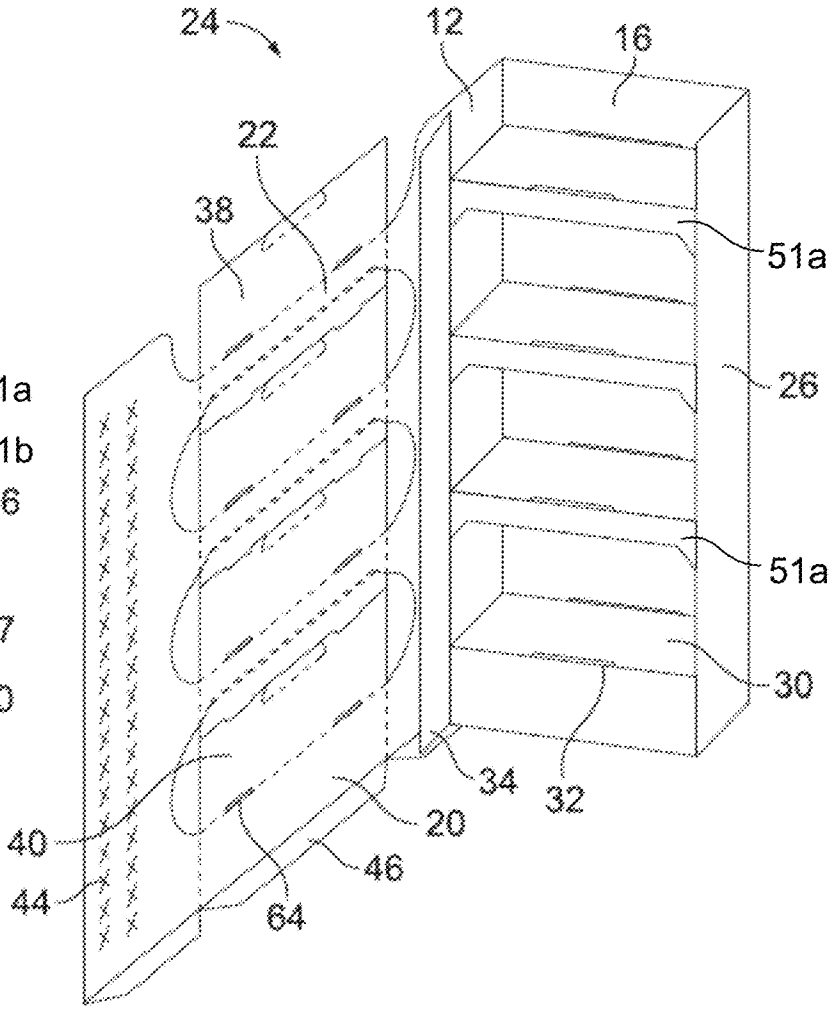
FIG. 3 PRIOR ART
FIG. 3 is a perspective view of the prior art blank of FIG. 1 further folded from the position in FIG. 2.
Figure 2:
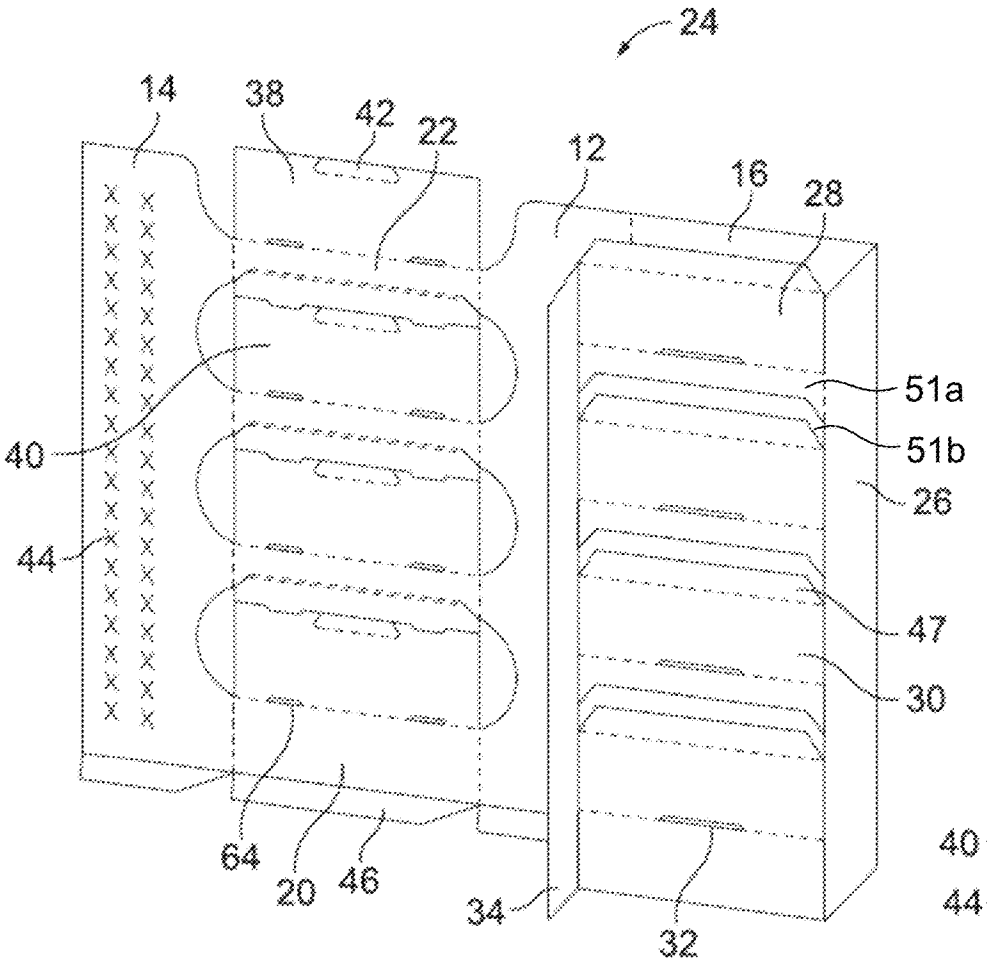
FIG. 2 PRIOR ART
FIG. 2 is a perspective view of the prior art blank of FIG. 1 partially folded into a shelving display.

Referring to FIG. 1, a blank of corrugated material 24 is shown that can be set up into the shelving display 10 shown in FIG. 6. As shown progressively in FIGS. 2-5, the blank 24 is folded into the proper shape and glued into place. Dashed lines on the blank 24 generally indicate fold lines where the blank 24 is folded to create the shelf display shown in FIG. 6. Certain bold lines indicate cut or perforated lines on the blank 24.

The blank 24 includes a back panel which forms the back wall 16. A panel that forms the first side wall 12 is integrally connected on one side to a first side of the panel that forms the back wall 16. The panel that forms the back wall 16 is integrally connected on its other side to a first side of a positioning panel 26.

The positioning panel 26 is integrally connected on a second side to one side of a first shelf panel 28. The first shelf panel 28 includes a plurality of first shelf components 30. Each of the first shelf components 30 includes a slot 32. The first shelf panel includes a segmented front panel 51 having a first portion 51*a* and a second portion 51*b*. The panel 30 is folded 90° downward toward the back wall 16 from the first portion 51*a* and the second portion 51*b* is removed.

A relatively thin strip panel 34 is integrally connected to the other side of the first shelf panel 28. The thin strip panel is provided with glue for securing the panel to another portion of the shelf display 24. A plurality of "X's" 36 are used to generally indicate the preferred areas for applying the glue.

The first side wall 12 is integrally connected on an opposing side (to the side connected to the back wall panel 16) to a first side of a second shelf panel 38. The second shelf panel 38 includes a plurality of second shelf components 40. The plurality of second shelf components 40 correspond to the plurality of first shelf components 30. Each of the plurality of second shelf components 40 includes a tab portion 42. The lower most shelf of the plurality of second shelf components 40 includes the front panel 20 that, in part, forms the base of the shelving display 10.

The second shelf panel 38 is integrally connected on a second side to a panel that forms the second side wall 14. The second side wall 14 also includes glue areas designated by "X's" 44.

The blank 24 also includes bottom flaps 46 extending downward from the first and second side walls 12, 14, the back wall 16 and the second shelf panel 38. The bottom flaps 46 are folded under the shelving display 10 when set up and form part of the base portion.

To set up the shelving display 10 from the blank 24, both the first side wall 12 and the positioning panel 26 are folded forward to be at a right angle with respect to the back wall 16. The first shelf panel 28 is then folded toward the first side wall 12, and the thin strip 34 is glued to an interior surface of the first side wall 12. This supports the first shelf panel 28 parallel to the back wall 16 at a distance equal to the width of the positioning panel 26.

The first shelf components 30 can be folded back toward the back wall 16 to form a back portion for each of the plurality of shelves 18. The first shelf components 30 can be glued to the back wall 16, or include structure, such as a tab 47, that can fit in slots 48 in the back wall 16. The slot 48 includes a horizontal portion 50 and two vertical portions 52, 54 on either side of the horizontal portion 50. A U-shaped opening 56 proximate the middle of the horizontal portion 50 is provided to allow one to pull a portion of the back wall 16 defined by the slots 48 and allow for placement of the tabs 47.

The second shelf panel 38 is folded across the first shelf panel 28, and the second side wall 14 is folded back toward the back wall 16. The glue on the second side wall 14 is used to secure the second side wall 14 to an outer surface of the positioning panel 26.

Once the second shelf panel 38 is positioned, the plurality of second shelf components 40 can be folded back toward the back wall 16 to form a complete shelf with the first shelf components 30 from the first shelf panel 28. The tabs 42 on the second components 40 can be inserted into the slots 32 on the first shelf components 30 to lock the first shelf component 30 to the second shelf component 40. Front panel 22 has a first portion 22*a* and a second portion 22*b* separated by a fold line. The panel 40 is folded 90° downward from the first portion 22*a* and the second portion 22*b* is folded 180° upward to be parallel with and positioned behind the first portion 22*a*. The second portion 22*b* includes a first tab 60 and a second tab 62 which are inserted into corresponding first and second slots 64, 66 on the top edge of the front panel 22 and the second shelf component 40.

Figure 7:
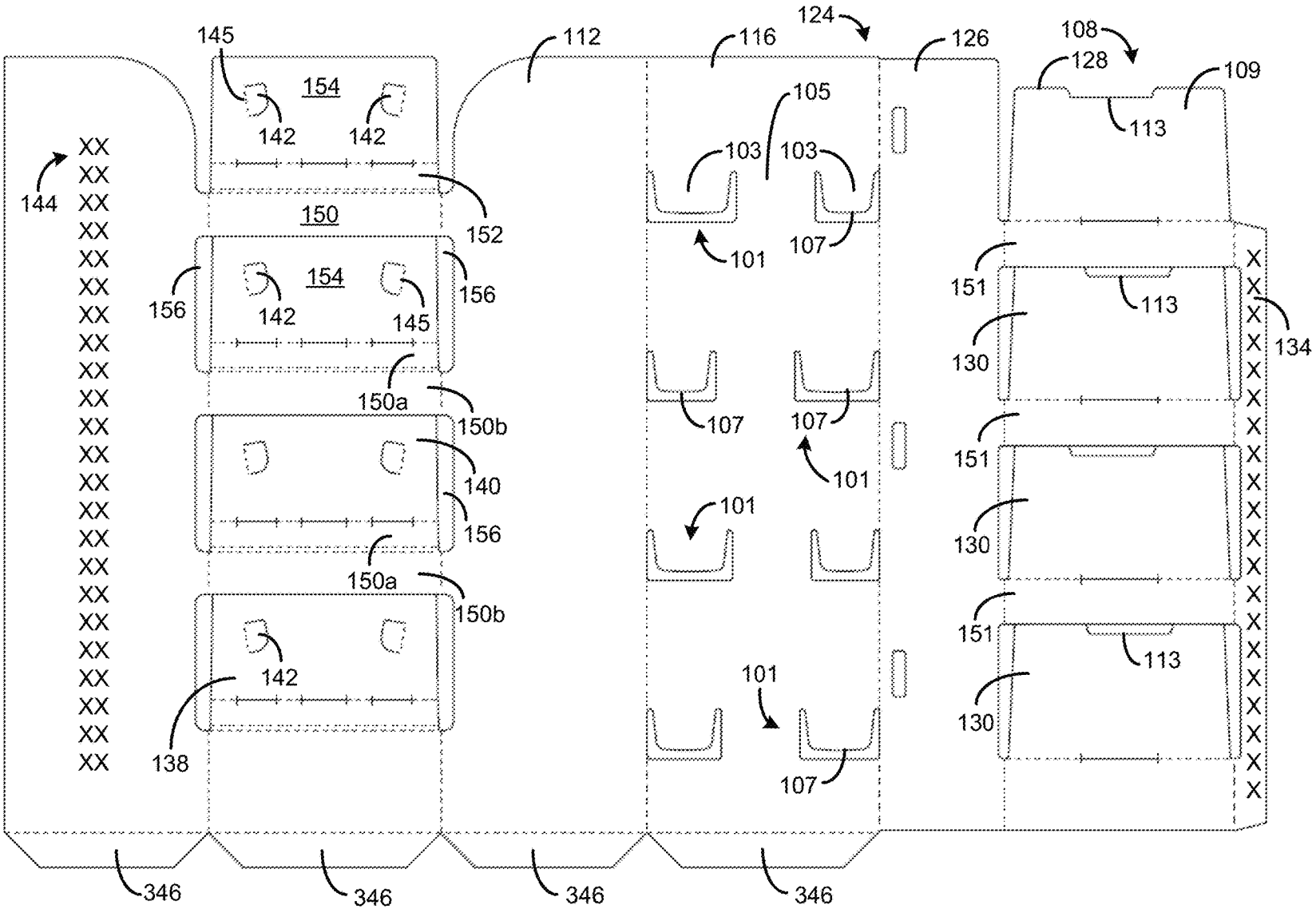
FIG. 7 is a top plan view of a blank of corrugated material for forming a shelving display of the present invention of FIG. 8.
Figure 8:
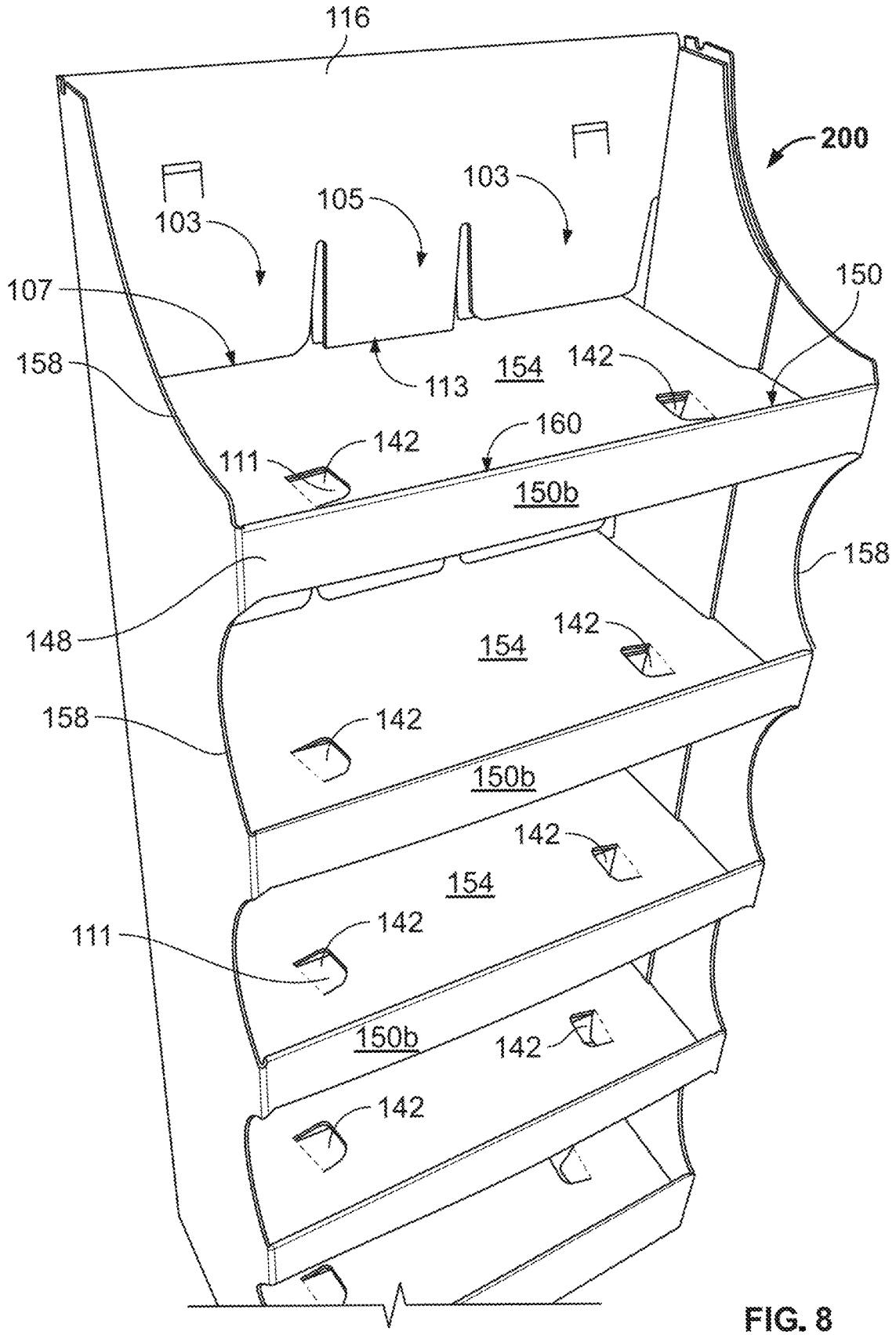
FIG. 8 is a front perspective view of the shelving display of the present invention.
Figure 9:
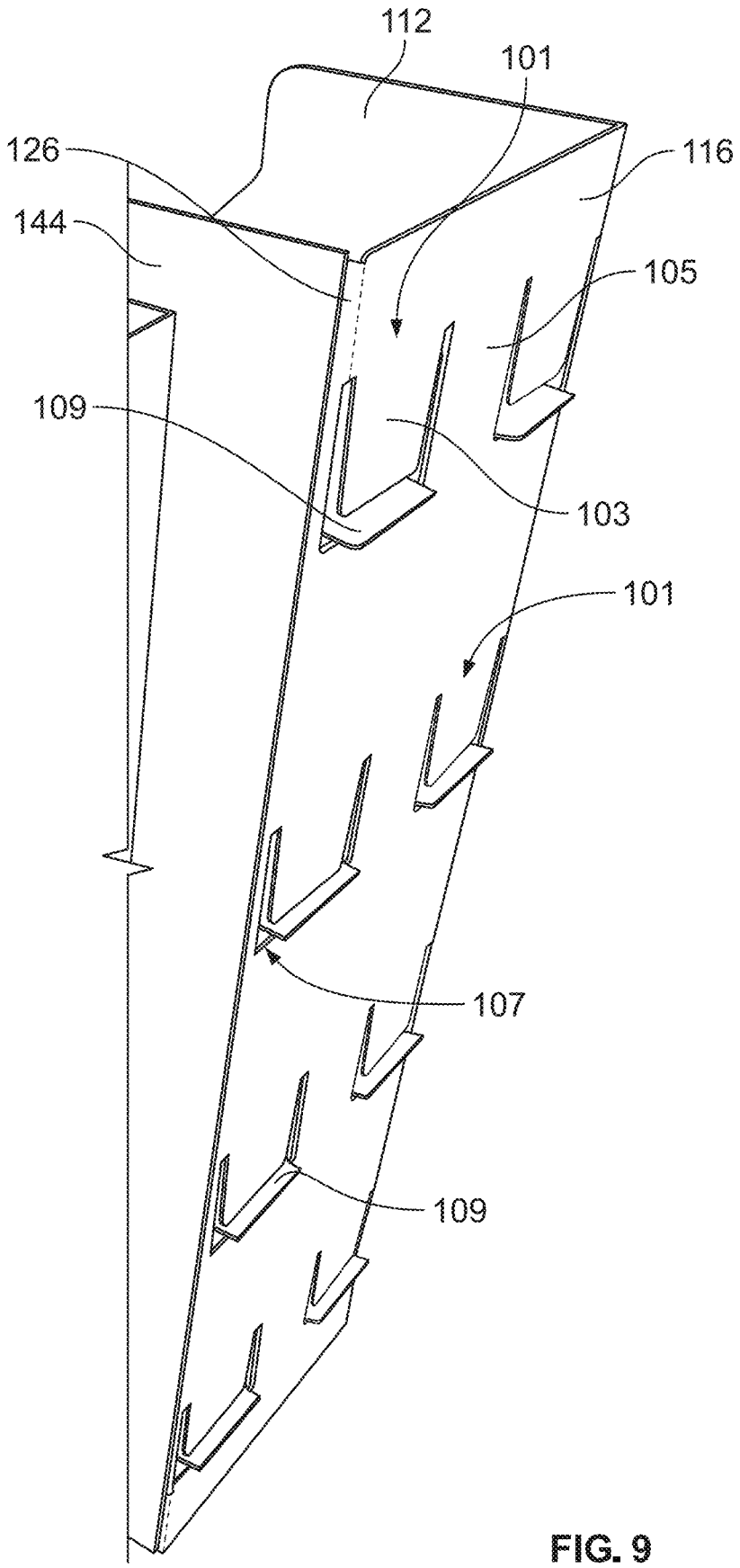
FIG. 9 is a rear-side perspective view of the shelving display of the present invention.
Figure 10:
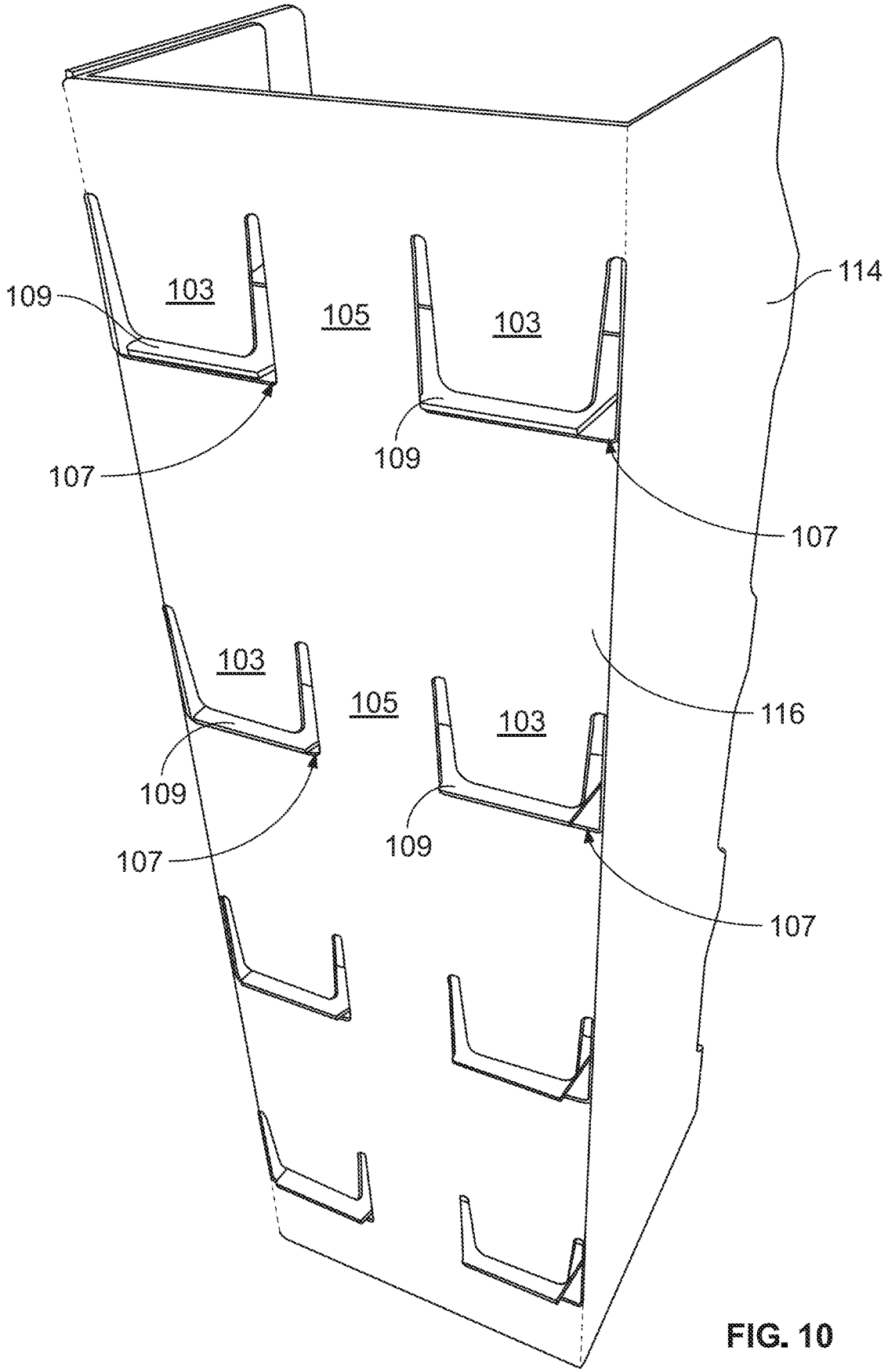
FIG. 10 is a rear perspective view of the shelving display of FIG. 8.

FIG. 7 discloses yet another embodiment of a blank 124 for forming a shelving display 200 of FIGS. 8 and 9. Blank 124 can be folded in similar but improved manner as blank 24 described above with reference to FIGS. 2-5, into the shelving display 200 as shown in FIGS. 8-10. There are differences in how the shelves are folded as will be described below. The blank 124 can be fabricated from paperboard, corrugated paperboard, plastic sheeting, corrugated plastic, and a tri-laminate board.

The blank 124 includes a back panel which forms the back wall 116. A panel that forms the first side wall 112 is integrally connected on one side to a first side of the panel that forms the back wall 116. The panel that forms the back wall 116 is integrally connected on its other side to a first side of a positioning panel 126. A plurality of U-shaped cutouts 101 in the back wall 116 are spaced from one another from a top edge of the blank 124 to a bottom edge of the blank as best seen in FIGS. 9 and 10. In a preferred form, the U-shaped cutouts 101 are in pairs and are spaced apart by a stop panel 105. Each U-shaped cutout 101 has a deflectable tab 103 and a slot 107 that extends through the full thickness of the back wall 116.

The positioning panel 126 is integrally connected on a second side to one side of a first shelf panel 128. The first shelf panel 128 includes a plurality of first shelf components 130. Each of the first shelf components 130 includes a tab receiving portion 111. As explained below, the first shelf components 130 are utilized to form the shelves 118 shown in FIG. 8. Each of the first shelf components 130 also include a leading edge 108, having two spaced-apart flanges 109 flanking a central recess 113. During the shelf-folding process, the two spaced apart flanges 109 are pressed against the deflectable tabs 103 and are guided into the pair of slots 107. A portion of the flange 109 extends through the back wall (FIGS. 9-10) and axially outward beyond an outer surface of the back wall. In this position, a downward facing edge of the deflectable tab 103 contacts an upper surface of the flange 131 to releasably retain the flange 109 in the slot 107 and to support the first shelf component. The central recess 113 abuts or is closely adjacent to the stop panel 105.

A relatively thin strip panel 134 is integrally connected to the other side of the first shelf panel 128. The thin strip panel 134 is provided with glue for securing the panel to another portion of the shelf display 134. A plurality of "X's" 134 are used to generally indicate the preferred areas for applying the glue.

The first side wall 112 is integrally connected on an opposing side (to the side connected to the back wall 116) to a first side of a second shelf panel 138. The second shelf panel 138 includes a plurality of second shelf components 140. The plurality of second shelf components 140 correspond to the plurality of first shelf components 130. Each of the plurality of second shelf components 140 include two frangible tabs 142. The frangible tab 142 is contained fully within the area of the second shelf panel and does not cross any perimeter edges. When the frangible tab 142 is pressed downward, a portion of the tab abuts a portion of a front panel 151 and is connected to the panel by a hinge 145.

Each of the second shelf panels 138 have a vertical front panel 150 and a hinge 152 connected to an object support surface 154. When formed into the shelving display 200, the vertical front panel 150 extends vertically above the shelf support surface 154 and acts as a lip to prevent products from sliding off the shelf support surface 154. The hinge 152 is folded 180° vertically downwardly behind the front panel 150 to form a double thickness vertical wall. Four of the five second shelf components also have two removable chads 156 at opposed lateral edges and are frangibly connected to the blank. Upon assembly of the shelf display 200 the removable chads 156 are torn away to form arcuate shaped 158 edges on a leading edge of the side walls.

The second shelf panel 138 is integrally connected on a second side to a panel that forms the second side wall 114. The second side wall 114 also includes glue areas designated by "X's" 144.

To set up the shelving display 200 from the blank 124, both the first side wall 112 and the positioning panel 126 are folded forward to be at a right angle with respect to the back wall 16. The first shelf panel 128 is then folded toward the first side wall 112, and the thin strip 134 is glued to an interior surface of the first side wall 112. This supports the first shelf panel 128 parallel to the back wall 116 at a distance equal to the width of the positioning panel 126.

The second shelf panel 138 is folded across the first shelf panel 128, and the second side wall 114 is folded back toward the back wall 116. The glue 144 on the second side wall 114 is used to secure the second side wall 114 to an outer surface of the positioning panel 126.

Here the folding sequence of each shelf is completed with two simple steps. First a constructor of the display presses down of the second panel 138 toward the back wall into contact with the first shelf panel 130. This causes the first shelf panel to move downwardly together with the second shelf panel where the flanges 109 contact the deflectable tabs 103. The tabs direct the flanges 109 into slots 107. In the second step, the constructor presses the frangible tabs 142 to force a portion of the tabs into contact with the vertical wall 151. This process is repeated until all of the shelves are formed. During these two steps, the second portion **150*b* of the front panel is folded downward and behind the first portion 150*a* into surface contact, or closely adjacent, an inner surface of the first portion 150*a* to form a double thickness front panel 150. A top of the first portion 150*b* extends above the support surface 154 and acts as a lip 160**.

While the display 100 has four shelves it is contemplated that the display can have from one shelf to 10 shelves, for example. More typically the display will have from two to six shelves.

Figure 11:
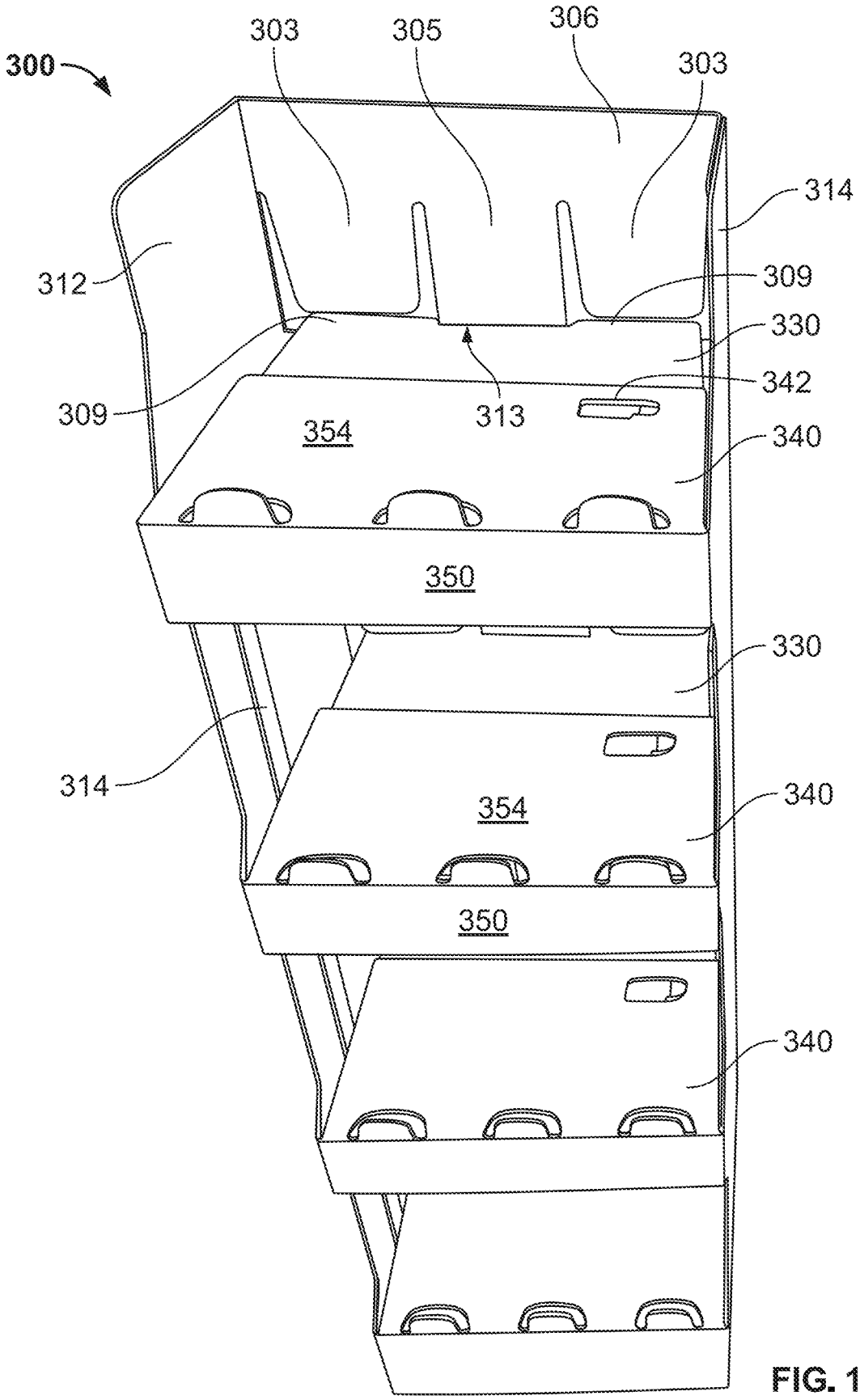
FIG. 11 is a front perspective view of an alternative shelving display also of the present invention.

FIG. 11 shows an alternative embodiment of a shelving display 300 to the shelving display 200 shown in FIG. 8 but differs in a few respects. The shelving display 300 is folded from a blank 324 shown in FIG. 12. Like parts will be referred to with like numbers of FIG. 7, but 300-series numbers are used in place of the 100-series number used in FIGS. 7 ad 8. First, in place of the two frangible tabs 142, there is a single frangible tab 342 and a tab receiving portion 311. The frangible tab 342 is dimensioned to fit within and be releasably retained in the receiving portion 111. Also, the hinge 142 is not present so the vertical panel 350 is directly connected to the object support surface 354 so there is no lip 160 spanning the entire width dimension of the front panel 350. The lip 160 is replaced by three upstanding tabs 360 horizontally spaced along a trailing edge of the second shelf component 340. The upstanding tabs 360 correspond with arcuate-shaped cutouts 362 on the second shelf component 31540.

Figure 12:
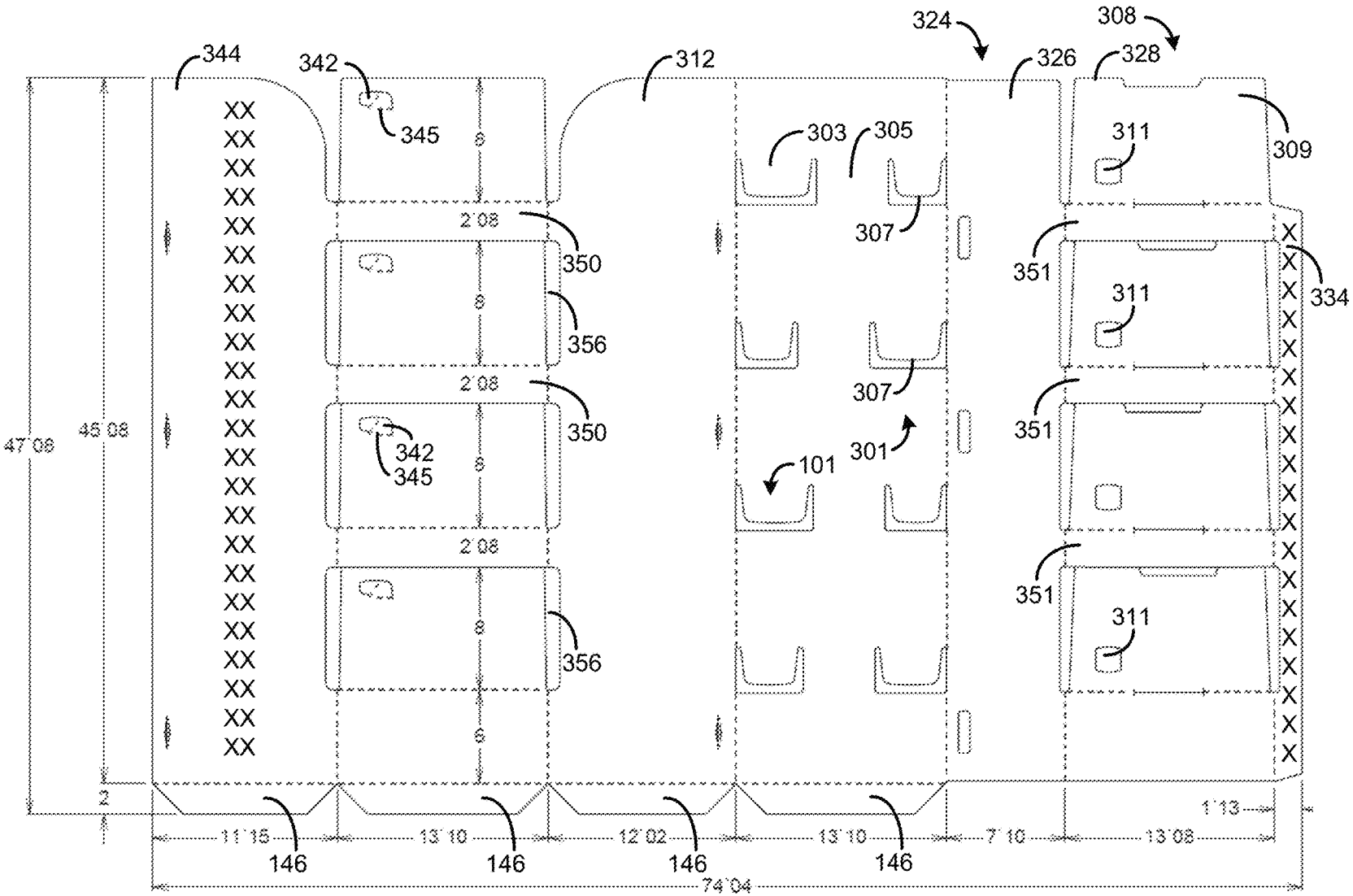
FIG. 12 is a top plan view of a blank of corrugated material for forming the shelving unit of FIG. 11.

FIG. 12 shows the blank 324 for forming the shelving display of FIG. 11. The blank 324 is folded in the same two-step process as the blank 124 is folded to form the display of FIG. 8.

While the specific embodiments have been illustrated and described, numerous modifications come to mind without significantly departing from the spirit of the invention and the scope of protection is only limited by the scope of the accompanying claims.

I claim:

1. A shelving display comprising:

a blank of material having a back wall panel, a first side wall panel extending outward from a first side of the back wall panel and a second side wall panel extending outward from a second side of the back wall panel;

a front shelf panel extending between a front portion of the first side wall panel and a front portion of the second side wall panel, the front shelf panel including a plurality of front shelf components wherein each of the front shelf components includes a first removable chad at a first lateral edge of the shelf component and a second removable chad at a second lateral edge of the shelf component that when removed form arcuate shaped leading edges on the first side wall and the second side wall.

2. The shelving display of claim 1 wherein each first removable chad is frangibly connected to the front shelf component and each second removable chad is frangibly connected to the front shelf component.

3. The shelving display of claim 1 further comprising an intermediate shelf panel extending between the first side wall panel and the second side wall panel, the intermediate shelf panel between the back wall panel and the front shelf panel and having a plurality of intermediate shelf components.

4. The shelving display of claim 3 wherein each of the plurality of intermediate shelf components includes a leading edge having a first flange and a second flange spaced from the first flange.

5. The shelving display of claim 4 wherein the back wall panel includes a plurality of U-shaped cutouts.

6. The shelving display of claim 5 wherein the plurality of U-shaped cutouts are positioned to engage the first flange and second flange of the plurality of intermediate shelf components.

7. The shelving display of claim 6 wherein the back wall panel includes a stop panel portion located between columns of the plurality of U-shaped cutouts.

8. The shelving display of claim 3 wherein each of the front panel shelf components includes a first tab contained within a support surface of the front panel shelf component.

9. The shelving display of claim 8 wherein the first tab is positioned to abut a first front portion of the intermediate shelf panel.

10. The shelving display of claim 9 wherein each of the front panel shelf components includes a second tab contained within the support surface of the front panel shelf component spaced from the first tab.

11. The shelving display of claim 10 wherein the second tab is positioned to abut a second portion of the intermediate shelf panel spaced from the first portion of the intermediate shelf panel.

12. The shelving display of claim 11 wherein the first tab is hingedly connected to the support surface of the front shelf component.

13. The shelving display of claim 3 wherein the front shelf panel includes a plurality of vertical walls that extend upward on each of the plurality of front shelf components from the first side wall panel to the second side wall panel.

14. The shelving display of claim 13 wherein each of the plurality of vertical walls is generally rectangular.

15. The shelving display of claim 3 wherein the front shelf panel includes a plurality of front tabs that extend upward from each of the plurality of front shelf components and wherein each front shelf component includes more than one of the plurality of front tabs.

16. The shelving display of claim 15 wherein each of the plurality of front shelf components includes three front tabs wherein each front tab is spaced from another front tab.

17. The shelving display of claim 16 wherein each front tab has an arcuate shape.

18. The shelving display of claim 1 wherein the blank is a single contiguous piece of material.

19. The shelving display of claim 1 wherein the display is made from corrugated paper.

20. The shelving display of claim 1 wherein the display is made from paperboard.

* * * * *